US007170539B2

(12) United States Patent
Nakatani et al.

(10) Patent No.: US 7,170,539 B2
(45) Date of Patent: Jan. 30, 2007

(54) THERMAL HEAD, METHOD FOR MANUFACTURING THE SAME, AND METHOD FOR ADJUSTING DOT ASPECT RATIO OF THERMAL HEAD

(75) Inventors: Toshifumi Nakatani, Niigata-ken (JP); Shuuichi Usami, Niigata-ken (JP); Hirotoshi Terao, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 197 days.

(21) Appl. No.: 11/031,299

(22) Filed: Jan. 6, 2005

(65) Prior Publication Data

US 2005/0146594 A1 Jul. 7, 2005

(30) Foreign Application Priority Data

Jan. 7, 2004 (JP) ..... 2004-002265

(51) Int. Cl.
*B41J 2/335* (2006.01)

(52) U.S. Cl. ..... 347/203

(58) Field of Classification Search ..... 347/200, 347/202, 203, 204, 208
See application file for complete search history.

(56) References Cited

U.S. PATENT DOCUMENTS 5,635,974 A * 6/1997 Yasutomi et al. ..... 347/203
5,969,743 A 10/1999 Tanaka
6,452,621 B1 * 9/2002 Nakamura ..... 347/208

FOREIGN PATENT DOCUMENTS

JP 03073362 A * 3/1991
JP 5-050630 3/1993

* cited by examiner

*Primary Examiner*—K. Feggins
(74) *Attorney, Agent, or Firm*—Brinks Hofer Gilson & Lione

(57) ABSTRACT

In a thermal head provided with a resistance layer having a plurality of heating element portions which generate heat by energization, an insulating barrier layer which determines the two-dimensional size of each heating element portion by covering each heating element portion, and electrode layers electrically connected to two end portions of each of the plural heating element portions, in the length direction of the resistance, a heat transfer layer is disposed on at least the insulating barrier layer to determine the two-dimensional surface exposure area of the insulating barrier layer by covering part of the insulating barrier layer and to dissipate the heat generated from the plural heating element portions, and surface exposure regions of the insulating barrier layer are specified as effective heating regions of the plural heating element portions by adjusting the two-dimensional size of the heat transfer layer.

9 Claims, 5 Drawing Sheets

THERMAL HEAD, METHOD FOR MANUFACTURING THE SAME, AND METHOD FOR ADJUSTING DOT ASPECT RATIO OF THERMAL HEAD

This application claims the benefit of priority to Japanese Patent Application No. 2004-002265 filed on Jan. 7, 2004, herein incorporated by reference.

BACKGROUND OF THE INVENTION

1. Field of the Invention

The present invention relates to a thermal head mounted on a thermal printer and the like, a method for manufacturing the same, and a method for adjusting a dot aspect ratio of a thermal head.

2. Description of the Related Art

In general, a thermal head includes a plurality of heating element portions which generate heat by energization, electrode layers to energize the plurality of heating element portions, and a protective layer to protect the plurality of heating element portions and part of the electrode layers, on a heat dissipating substrate provided with a heat storage layer. The heating element portion generating heat is pressed against an ink ribbon and a printing substrate wound around a platen roller and, thereby, the printing operation is performed. In such a known thermal head, each heating element portion to produce one printing dot is formed into the shape of a rectangle. But, it is desirable that the aspect ratio (length-to-width ratio) L/W of one printing dot is brought close to 1 (square pixel) as much as possible in order that the printing can be performed with high precision in both the vertical direction and the horizontal direction, as disclosed in Japanese Unexamined Patent Application Publication No. 5-50630.

However, when the dot aspect ratio L/W is brought close to 1, the amount of etching tends to vary in a photolithography step to form a plurality of heating element portions, and there is a problem in that variations in resistance value (dot resistance value) of the plurality of heating element portions are increased. Variations in dot resistance value must be minimized since variations in dot resistance value cause variations in printing concentration during printing. If variations in dot resistance value exceed a specific level, no product of satisfactory quality is attained and, therefore, the yield is decreased. When the dot aspect ratio L/W is brought close to 1, the area thereof becomes smaller than the area of a known heating element portion. Consequently, the dot resistance value must be increased, and a detriment occurs in that each heating element portion must be formed from a resistance material having a high resistivity.

SUMMARY OF THE INVENTION

It is an object of the present invention to provide a thermal head in which variations in dot resistance value are reduced, a desired dot aspect ratio can be attained without using any heating element portion having a high resistivity and, thereby, high-quality printing can be realized, a method for manufacturing the same, and a method for adjusting a dot aspect ratio of a thermal head.

The present invention is based on findings that when the two-dimensional sizes of a plurality of heating element portions are specified to be rectangular (aspect ratio >>1) by insulating barrier layers, the plurality of heating element portions can be readily produced and variations in dot resistance value are reduced and that the dot aspect ratio can be readily adjusted by regulating effective heating regions of the plural heating element portions.

A thermal head according to an aspect of the present invention includes a resistance layer having a plurality of heating element portions which generate heat by energization, an insulating barrier layer which is disposed covering individually the plural heating element portions and which determines the two-dimensional size of each heating element portion, and electrode layers electrically connected to two end portions of each of the plural heating element portions, in the length direction of the resistance, wherein a heat transfer layer is provided on at least the insulating barrier layer to determine the two-dimensional surface exposure area of the insulating barrier layer by covering part of the insulating barrier layer and to dissipate the heat generated from the plurality of heating element portions, and surface exposure regions of the insulating barrier layer are specified as effective heating regions of the plurality of heating element portions by the heat transfer layer.

According to another aspect of the present invention, a method for manufacturing a thermal head including a plurality of heating element portions which generate heat by energization and electrode layers electrically connected to two end portions of each of the plural heating element portions, in the length direction of the resistance is provided, the method including the steps of forming an insulating barrier layer to determine the two-dimensional size of each heating element portion by covering the surfaces of the plural heating element portions and, thereafter, forming a heat transfer layer on at least the insulating barrier layer to determine the surface exposure area of the insulating barrier layer by covering part of the insulating barrier layer and to dissipate the heat generated from the plurality of heating element portions; and specifying the surface exposure regions of the insulating barrier layer as effective heating regions of the plural heating element portions by the heat transfer layer.

Preferably, the two-dimensional shape of the effective heating region of the heating element portion is specified to be square by the heat transfer layer. When the two-dimensional shape of the effective heating region of the heating element portion is square, one printing dot becomes a square pixel and, therefore, the printing quality is improved.

Preferably, the two-dimensional shape of each heating element portion specified by the insulating barrier layer is rectangular. When the two-dimensional shape of the heating element portion is rectangular, that is, when the aspect ratio of the heating element portion is larger than 1, variations in amount of etching can be reduced in the step of forming the plurality of heating element portions compared with that in the case where the two-dimensional shape of the heating element portion is specified to be square. Consequently, variations in dot resistance value are also reduced. Furthermore, the dot resistance value can be ensured even when the heating element portion is not formed from a resistance material having a high resistivity. The two-dimensional shape of the effective heating region of each heating element portion can be readily specified to be square by the above-described heat transfer layer even when the two-dimensional shape of each heating element portion is rectangular.

A pair of the heat transfer layers having a predetermined spacing in the direction parallel to the length direction of the resistance of the heating element portion may be disposed on the insulating barrier layer. In this case, preferably, the electrode layers are disposed on the resistance layer while being in contact with two respective end portions of each of the plural heating element portions in the length direction of the resistance and the heat transfer layers. Alternatively, a pair of the heat transfer layers having a predetermined spacing in the direction parallel to the length direction of the resistance of the heating element portion may be disposed on the insulating barrier layer and the resistance layer, and preferably, electrode layers are disposed on the heat transfer layers.

Preferably, the heat transfer layer is formed from a metallic material having a melting point higher than a maximum exothermic temperature of the heating element portion. More preferably, the heat transfer layer is formed from a high-melting point metallic material containing at least one of Cr, Ti, Ta, Mo, and W.

According to another aspect of the present invention, a method for adjusting a dot aspect ratio of a thermal head is provided, the thermal head including a plurality of heating element portions which generate heat by energization, electrode layers electrically connected to two end portions of each of the plurality of heating element portions in the length direction of the resistance, an insulating barrier layer to determine the two-dimensional sizes of the heating element portions by covering the surfaces of the plural heating element portions, and a heat transfer layer which is formed covering part of the insulating barrier layer and dissipates the heat generated from the plural heating element portions, wherein the method includes the step of adjusting the aspect ratio of an effective heating region of each heating element portion by changing the two-dimensional sizes of the heat transfer layers.

According to the present invention, since the heat transfer layer is provided to determine the two-dimensional surface exposure area of the insulating barrier layer by covering part of the insulating barrier layer and to dissipate the heat generated from the plurality of heating element portions, and the surface exposure regions of the insulating barrier layer are specified as effective heating regions of the plural heating element portions by the heat transfer layer, the effective heating regions and the dot aspect ratios of the plurality of heating element portions can readily be changed by adjusting the two-dimensional sizes of the heat transfer layers (spacing between them, length dimension, and width dimension). In particular, when the two-dimensional sizes of the plurality of heating element portions are specified to be rectangular (aspect ratio >>1) by insulating barrier layers and the dot aspect ratios of the plurality of heating element portions are substantially specified to be 1 by the heat transfer layers, one printing dot can be made a square pixel while variations in dot resistance value are reduced. Consequently, high image quality can be attained when the direction of the printing is either a vertical direction or a horizontal direction and, therefore, high-quality printing can be realized.

DESCRIPTION OF THE PREFERRED EMBODIMENTS

Figure 1:
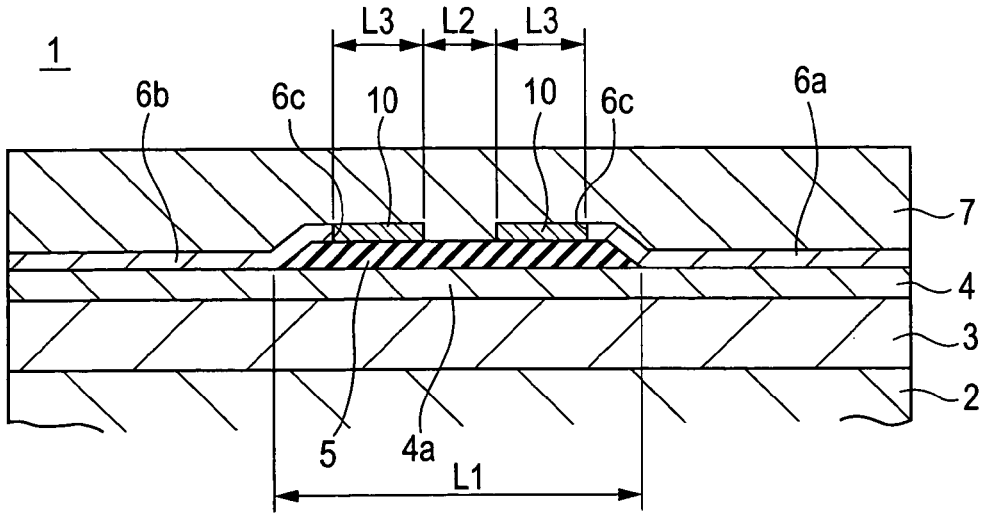
FIG. 1 is a sectional view showing a thermal head according to a first embodiment of the present invention.
Figure 2:
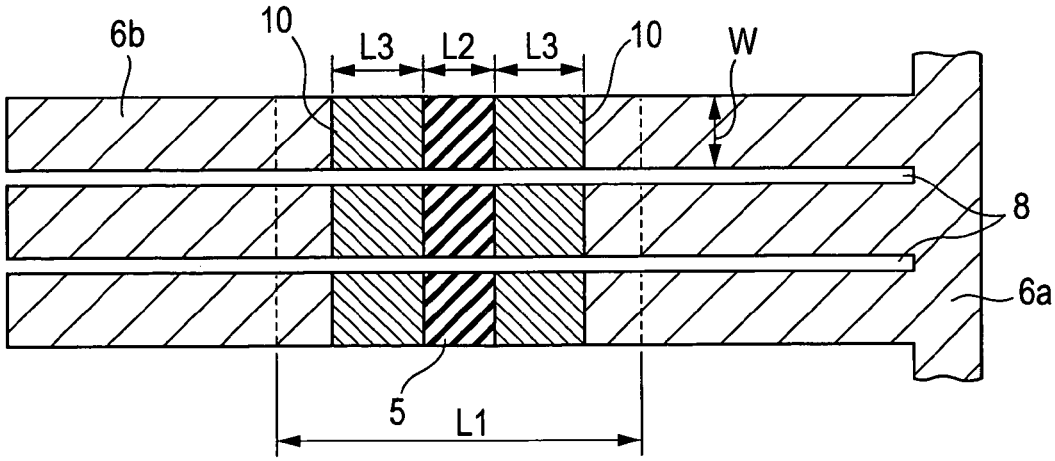
FIG. 2 is a plan view of the thermal head (in the condition before an abrasion-resistant protective layer is formed) shown in FIG. 1.

FIG. 1 and FIG. 2 are a sectional view and a plan view (except an abrasion-resistant protective layer), respectively, showing the first embodiment of a thermal head according to the present invention. The present thermal head 1 is provided with a plurality of heating element portions 4*a* which generate heat by energization, an insulating barrier layer 5 covering the surface of each heating element portion 4*a*, electrode layers 6 electrically connected to two end portions of each of the plural heating element portions 4*a* in the length direction of the resistance, and an abrasion-resistant protective layer 7 on a heat dissipating substrate 2 including a heat storage layer 3. This thermal head 1 is mounted on a photo printer or a thermal printer, and performs printing by applying heat generated from each heating element portion 4*a* to thermal paper or an ink ribbon. Although not shown in the drawing, the thermal head 1 is also provided with a driving IC, a printed circuit board, and the like to control energization of the plurality of heating element portions 4*a*.

The plurality of heating element portions 4*a* are part of a resistance layer 4 disposed all over the heat storage layer 3 and, as shown in FIG. 2, are arranged having spacing in a direction perpendicular to the drawing, FIG. 1. The two-dimensional size (a length dimension (dot length) L1 and a width dimension (dot width) W) of each heating element portion 4*a* is individually determined by the insulating barrier layer 5 covering the surface thereof, and the aspect ratio L1/W of each heating element portion 4*a* is adequately larger than 1. In the present specification, the aspect ratio L1/W of the heating element portion 4*a* is simply referred to as "an aspect ratio L1/W". The resistance value of each heating element portion 4*a*, that is, one dot resistance value, is determined by (sheet resistance of resistance layer 4)× (aspect ratio L1/W). In the present embodiment, a gap region 8 is disposed between adjacent heating element portions 4*a*, and the insulating barrier layer practically determines the length dimension L1 of each heating element portion 4*a*. The insulating barrier layers 5 further have the function of preventing surface oxidation of the plurality of heating element portions 4*a* and the function of protecting the plurality of heating element portions 4*a* from etching damage during the manufacturing process.

The electrode layer 6 is disposed by forming a film all over the resistance layer 4 and the insulating barrier layers 5 and, thereafter, providing opening portions 6*c* to exposing the insulating barrier layers 5, and two end portions of the electrode layer 6 on the insulating barrier layer 5 side are overlaid on the insulating barrier layer 5. As shown in FIG. 2, this electrode layer 6 includes one common electrode layer 6*a* connected to all the plurality of heating element portions 4*a* and a plurality of individual electrodes 6*b* individually connected to the plural heating element portions 4*a*. The width dimension W of the plurality of individual electrodes 6*b* is regulated by the gap regions 8 disposed between adjacent individual electrodes 6*b*. The electrode layer 6 is formed from an Al conductor film, for example. The abrasion-resistant protective layer 7 is formed covering the surfaces of the common electrode layer 6*a*, the insulating barrier layers 5, the plurality of heating element portions 4*a*, and the plurality of individual electrodes 6*b*, and protects the common electrode layer 6*a*, the insulating barrier layers 5, the plurality of heating element portions 4*a*, and the plurality of individual electrodes 6*b* from contact with the ink ribbon and the like.

The thermal head 1 having the above-described configuration is further provided with heat transfer layers 10 to determine the two-dimensional surface exposure areas of the insulating barrier layers 5 by covering part of the insulating barrier layers 5 and to dissipate (diffuse) the heat generated from the plurality of heating element portions 4*a*. A pair of the heat transfer layers having a predetermined spacing L2 in the direction parallel to the length direction of the resistance of the plurality of heating element portions 4*a* are disposed on the insulating barrier layer 5, and are in contact with respective end portions of the electrode layer 6 on the insulating barrier layer 5 side. This heat transfer layer 10 is made of a metallic material having a melting point higher than a maximum exothermic temperature of each heating element portion 4*a*. In particular, it is preferable that the heat transfer layer is made of a high-melting point metallic material containing at least one of Cr, Ti, Ta, Mo, and W.

Figure 11:
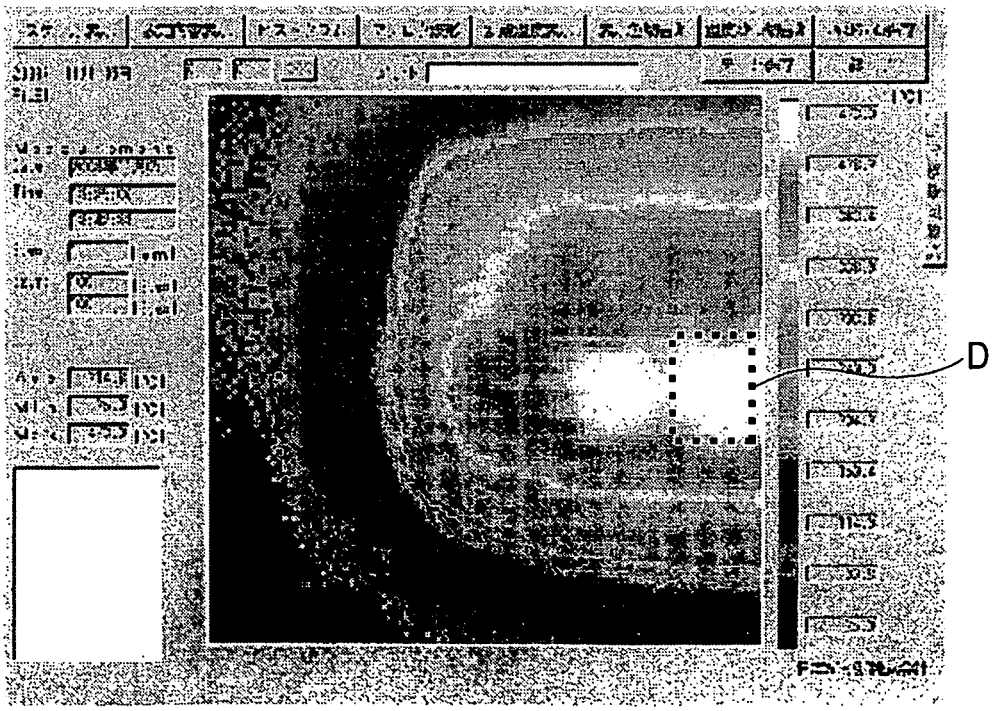
FIG. 11 is an exothermic distribution diagram showing the surface temperature condition when a plurality of heating element portions are energized in the thermal head shown in FIG. 1.

As shown in FIG. 11, in a region where the heat transfer layer 10 is present on the insulating barrier layer 5, even when the heating element portion 4*a* generates heat by energization, the heat generated from the heating element portion 4*a* is dissipated in a short time (instantaneously) in the length direction of the resistance of the heating element portion 4*a* through the heat transfer layer 10 and, thereby, the head surface temperature does not become high. Consequently, a region where the head surface temperature becomes high by the heat generation of the heating element portion 4*a* is the region where the heat transfer layer 10 is not present and the surface of the insulating barrier layer 5 is exposed. In the present specification, the region where the head surface temperature actually becomes high by the heat generation of the heating element portion 4*a* is referred to as "an effective heating region of the heating element portion 4*a*", and the aspect ratio of the effective heating region of the heating element portion 4*a* is referred to as "a dot aspect ratio". This effective heating region of the heating element portion 4*a* is one printing dot. The formation region (two-dimensional size) of the above-described heat transfer layer 10 is adjusted to change the surface exposure region of the insulating barrier layer 5 and, thereby, the effective heating region of the heating element portion 4*a* can readily be determined at will. In the present embodiment, the heat transfer layers 10 (length dimension L3 and width dimension W) are formed to have spacing L2 subsequently equal to the width dimension W of the heating element portion 4*a* in the direction parallel to the length direction of the resistance of the plurality of heating element portions 4*a*, and the two-dimensional shape of the effective heating region of each heating element portion 4*a* is specified to be square (length dimension W and width dimension W). In this manner, the dot aspect ratio (L2/W) becomes subsequently equal to 1. When the effective heating region of the heating element portion 4*a*, that is, one printing dot, is made to be a square pixel as described above, high image quality can be attained while the direction of the printing is either a vertical direction or a horizontal direction and, therefore, high-quality printing can be realized.

An embodiment of a method for manufacturing the thermal head 1 shown in FIG. 1 and FIG. 2 will be described below with reference to FIGS. 3A and 3B to FIGS. 5A and 5B. In each drawing, A is a sectional view showing a manufacturing step and B is a plan view showing the manufacturing step.

Figure 3A:
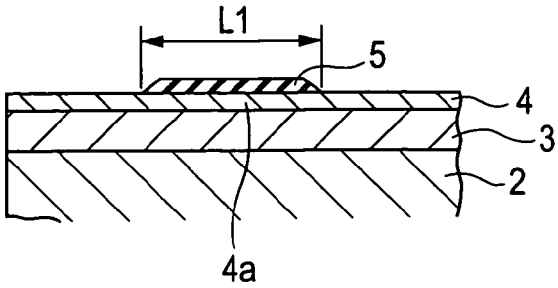
FIGS. 3A and 3B are a sectional view and a plan view, respectively, showing one step of a method for manufacturing the thermal head shown in FIG. 1.
Figure 3B:
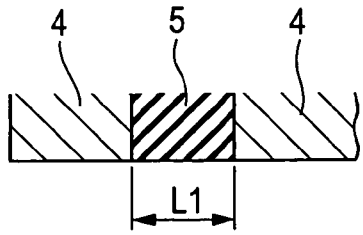

As shown in FIGS. 3A and 3B, the resistance layer 4 is formed on the dissipating substrate 2 including the heat storage layer 3. A sputtering method or an evaporation method can be used for the film formation. The resistance layer 4 is formed from a cermet material of high-melting point metal, e.g., Ta—Si—O, Ti—Si—O, Cr—Si—O, or the like.

As shown in FIGS. 3A and 3B, the insulating barrier layer 5 having a length dimension of L1 is formed on the resistance layer 4 to have a film thickness of about 600 angstroms, for example. Preferably, the insulating barrier layer 5 is formed from a material which is an insulating material having oxidation resistance and which is applicable to reactive ion etching (RIE). Specifically, it is preferable that $SiO_2$, $Ta_2O_5$, SiN, $Si_3N_4$, SiON, AlSiO, SiAlON, or the like is used. The resistance layer 4 covered with these insulating barrier layers 5 becomes the plurality of heating element portions 4*a* having a dot resistance length of L1 in the future. The insulating barrier layer 5 can be formed by RIE or a lift-off method. When RIE is used, the insulating barrier layer 5 may be formed all over the resistance layer 4 by sputtering or the like, a resist layer to determine the length dimension LI may be formed on the insulating barrier layer 5 and, thereafter, the insulating barrier layer not covered with the resist layer may be removed by RIE. On the other hand, when the lift-off method is used, a resist layer including an opening having a length dimension of L1 may be formed on the resistance layer 4, the insulating barrier layer 5 may be formed thereon and, thereafter, the resist layer and the insulating barrier layer on the resist layer may be lifted off. In both methods, the resistance layer 4 to become the plurality of heating element portions 4*a* does not sustain etching damage nor is the surface oxidized during the formation of the insulating barrier layer 5.

After the insulating barrier layer 5 is formed, an annealing treatment is performed. This annealing treatment is performed to reduce the rate of change in resistance of the heating element portion 4*a* after the use of the head is started, and is an acceleration treatment in which the resistance layer 4 is stabilized by application of a large thermal load. After the annealing treatment, in order to improve the adhesion between the electrode layer formed in a following step and the resistance layer 4, ion beam etching or reverse sputtering is performed and a surface oxidized layer of the resistance layer 4 is removed. By performing this ion beam etching or reverse sputtering, the resistance layer 4 covered with the insulating barrier layer 5 is not etched, and the resistance layer 4 not covered with the insulating barrier layer 5 is cut, so that an oxidized layer generated on the surface thereof is removed.

Subsequently, the electrode layer 6 is formed on the resistance layer 4 from which surface oxidized layers have been removed and the insulating barrier layer 5. The sputtering method or the evaporation method is used for the film formation. In the present embodiment, the electrode layer 6 is formed from Al to have a film thickness of about 0.2 to 3 μm. Since the surface oxidized layers have been removed, the adhesion between the resistance layer 4 and the electrode layer 6 becomes excellent, and variations in resistance value of the heating element portion 4*a* resulting from loose contact of the electrode layer 6 can be reduced.

Figure 4A:
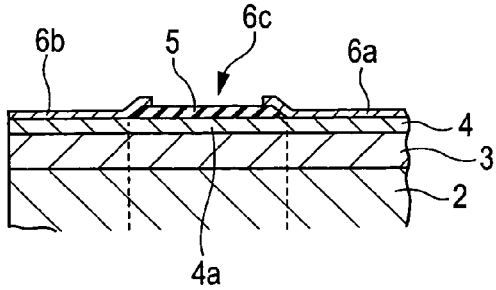
FIGS. 4A and 4B are a sectional view and a plan view, respectively, showing one step performed following the step shown in FIGS. 3A and 3B.
Figure 4B:
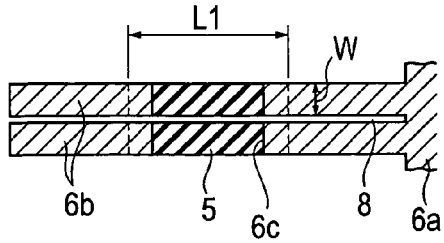

After the electrode layer 6 is formed, the photolithography is used and, thereby, the pattern shape (width dimension W) of the electrode layer 6 is specified. Furthermore, an opening portion 6*c* to expose the surface of the insulating barrier layer 5 is formed. The step of specifying the pattern shape of the electrode layer 6 and the step of forming the opening portion 6*c* of the electrode layer 6 are in no particular order. In the present embodiment, two end portions of the electrode layer 6 on the insulating barrier layer 5 side are overlaid on the insulating barrier layer 5, and the amount of the overlaying is specified to be about 3 to 20 μm. By performing this step, as shown in FIGS. 4A and 4B, unnecessary portions of the electrode layer 6, the insulating barrier layer 5, and the resistance layer 4 are removed, the gap region 8 at which the heat storage layer 3 is exposed is formed, and the electrode layer 6 is separated into the common electrode layer 6*a* and the individual electrode layer 6*b* with the opening portion 6*c* therebetween. Furthermore, the individual electrode layer 6*b* is divided by the gap regions 8 into a plurality of individual electrodes 6*b*, and the resistance layer 4 exposed at the opening portion 6*c* is divided by the gap regions 8 into a plurality of heating element portions 4*a*. With respect to the plurality of heating element portions 4*a*, the length dimension (dot length) is specified to be L1 by the length dimension L1 of the insulating barrier layer 5, and the width dimension (dot width) is specified to be W by the gap regions 8. Consequently, the dot resistance value becomes the sheet resistance of the resistance layer 4 by the aspect ratio (L1/W) of the heating element portion 4*a*. The plurality of heating element portions 4*a* and insulating barrier layers 5 are arranged having infinitesimal spacing in a direction perpendicular to the drawing, FIG. 4A.

Figure 5A:
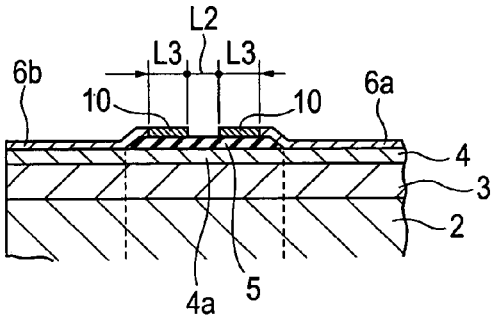
FIGS. 5A and 5B are a sectional view and a plan view, respectively, showing one step performed following the step shown in FIGS. 4A and 4B.
Figure 5B:
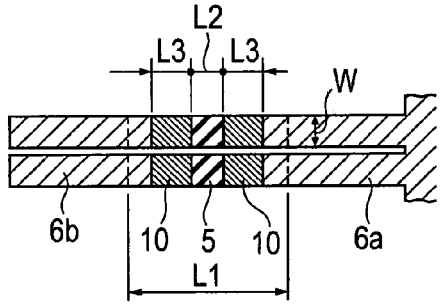

Subsequently, as shown in FIGS. 5A and 5B, a pair of heat transfer layers 10 having a spacing L2 in the direction parallel to the length direction of the resistance of the heating element portion 4*a* are formed on the insulating barrier layer 5 by the photolithography while being in contact with end portions of the electrode layer 6 on the insulating barrier layer 5 side. At this time, the spacing L2 between the pair of heat transfer layers 10 and the width dimension of the heat transfer layer 10 are made to agree the width dimension W of the insulating barrier layer 5. In this manner, both end portions of the insulating barrier layer 5 in the length direction are covered with the heat transfer layers 10, and the two-dimensional shape of the surface exposure region of the insulating barrier layer 5 not covered with the heat transfer layer 10 becomes square. That is, the dot aspect ratio (L2/W) is substantially 1. This heat transfer layer 10 is formed from a metallic material having a melting point higher than a maximum exothermic temperature of the heating element portion 4*a*. In particular, it is preferable that the heat transfer layer is formed from a high-melting point metallic material containing at least one of Cr, Ti, Ta, Mo, and W. When the insulating barrier layer 5 is covered with the heat transfer layer 10, the heat from the heating element portion 4*a* is dissipated instantaneously in the length direction of the resistance of the heating element portion 4*a* through the heat transfer layer 10 and, thereby, the head surface temperature becomes lower than that of the surface exposure region of the insulating barrier layer 5 not covered with the heat transfer layer 10. That is, the square insulating barrier layer 5 exposed at the surface becomes the effective heating region of each heating element portion 4*a*. The spacing L2 between the above-described pair of heat transfer layers 10 can be appropriately adjusted, and the effective heating region of each heating element portion 4*a* can readily be specified by changing this spacing L2.

After the heat transfer layer 10 is formed, fresh film surfaces of the insulating barrier layer 5, the heat transfer layer 10, and the electrode layer 6 are exposed by ion beam etching or reverse sputtering, so that the adhesion to the abrasion-resistant protective layer formed in a following step is ensured. In this step as well, the plurality of heating element portions 4*a* are covered with the insulating barrier layer 5 and, therefore, do not sustain damage due to etching. The resistance values of the plurality of heating element portions are not changed. Subsequently, the abrasion-resistant protective layer 7 made of an abrasion-resistant material, e.g., SiAlON or $Ta_2O_5$, is formed on the insulating barrier layer 5, the heat transfer layer 10, and the electrode layer 6 with fresh film surfaces exposed. In this manner, the thermal head 1 shown in FIG. 1 and FIG. 2 is attained.

According to the present embodiment described above, since the heat transfer layers 10 are provided to determine the two-dimensional surface exposure areas of the insulating barrier layers 5 by covering part of the insulating barrier layers 5 and to dissipate the heat generated from the plurality of heating element portions 4*a*, the effective heating regions and the dot aspect ratios (L2/W) of the plurality of heating element portions 4*a* can readily be changed by adjusting the two-dimensional sizes of the heat transfer layers 10 (spacing L2, length dimension L3, and width dimension). In particular, when the two-dimensional sizes of the plurality of heating element portions 4*a* are specified to be rectangular (aspect ratio (L1/W) of heating element portion 4*a* >>1) by the insulating barrier layers 5 and the dot aspect ratios (L2/W) of the plurality of heating element portions 4*a* are brought close to 1 by the heat transfer layers 10, one printing dot (effective heating region of each heating element portion) can be made a square pixel while variations in resistance value of the plurality of heating element portions 4*a* are reduced.

Figure 6:
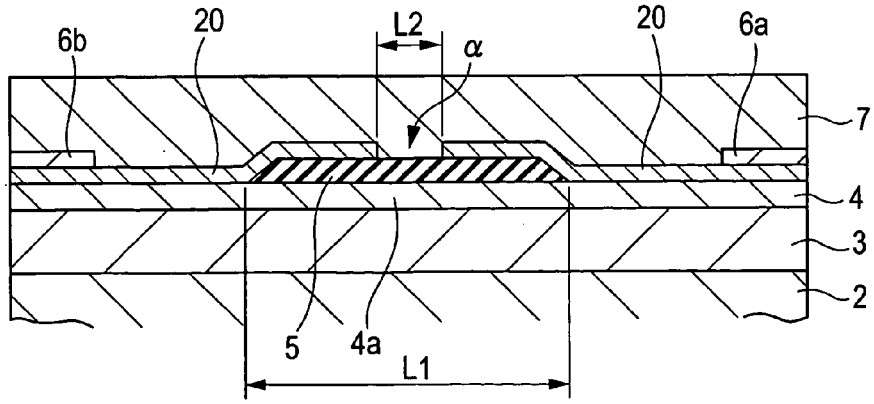
FIG. 6 is a sectional view showing a thermal head according to a second embodiment of the present invention.
Figure 7:
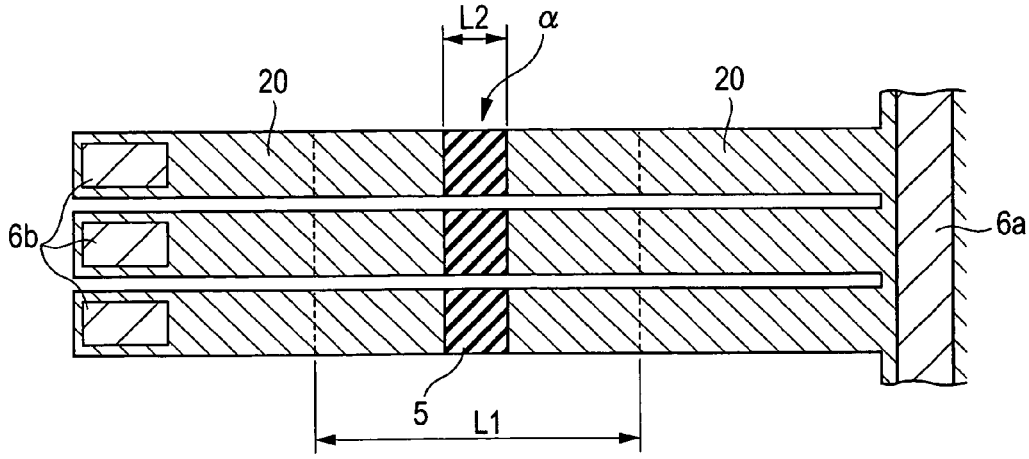
FIG. 7 is a plan view of the thermal head (in the condition before an abrasion-resistant protective layer is formed) shown in FIG. 6.

FIG. 6 and FIG. 7 are a sectional view and a plan view, respectively, showing the second embodiment of a thermal head according to the present invention. A thermal head 100 according to the second embodiment is provided with heat transfer layers 20 to determine the two-dimensional surface exposure areas of the insulating barrier layers 5 by covering part of the insulating barrier layers 5 and to dissipate the heat generated from a plurality of heating element portions 4*a*. Electrode layers 6 are disposed on these heat transfer layers 20. More specifically, a pair of the heat transfer layers 20 having a spacing L2 in the direction parallel to the length direction of the resistance of the plurality of heating element portions 4*a* are disposed on the insulating barrier layer 5 and the resistance layer 4. A common electrode layer 6*a* is disposed on one heating element portion 20, and a plurality of individual electrodes 6*b* are disposed on the other heat transfer layer 20. These heat transfer layers 20 perform the function as part of the electrode layers 6. In FIG. 6 and FIG. 7, constituents having the function similar to that in the first embodiment are indicated by the same reference numerals as those in FIG. 1 and FIG. 2.

An embodiment of a method for manufacturing the thermal head 100 shown in FIG. 6 and FIG. 7 will be described below with reference to FIGS. 8A and 8B and FIGS. 9A and 9B. In each drawing, A is a sectional view showing a manufacturing step and B is a plan view showing the manufacturing step. Since the steps up to the formation of the insulating barrier layer 5 are similar to those in the above-described first embodiment, the steps following the formation of the insulating barrier layer 5 will be described below.

Figure 8A:
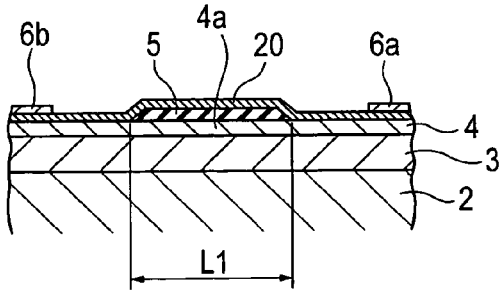
FIGS. 8A and 8B are a sectional view and a plan view, respectively, showing one step of a method for manufacturing the thermal head shown in FIG. 6.
Figure 8B:
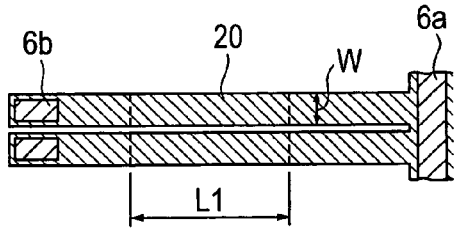

After the insulating barrier layer 5 is formed, the heat transfer layer 20 and the electrode layer 6 are formed all over the insulating barrier layer 5 and the resistance layer 4. By photolithography, the pattern shape of the electrode layer 6 is specified, and unnecessary portions of the electrode layer 6, the heat transfer layer 20, the insulating barrier layer 5, and the resistance layer 4 are removed. By performing this step, as shown in FIGS. 8A and 8B, a common electrode layer 6*a* and a plurality of individual electrodes 6*b* are formed on the heat transfer layer 20, and a gap region 8 is formed between adjacent individual electrodes 6*b*. At the same time, the resistance layer 4 covered with the insulating barrier layer 5 is divided by the gap regions 8 into a plurality of heating element portions 4*a*. With respect to the plurality of heating element portions 4*a*, the length dimension (dot length) is specified to be L1 by the length dimension L1 of the insulating barrier layer 5, and the width dimension (dot width) is specified to be W by the gap regions 8. Consequently, the dot resistance value becomes the sheet resistance of the resistance layer 4 by the aspect ratio (L1/W) of the heating element portion 4*a*. The plurality of heating element portions 4*a* and insulating barrier layers 5 are arranged having infinitesimal spacing in a direction perpendicular to the drawing, FIG. 8A.

Figure 9A:
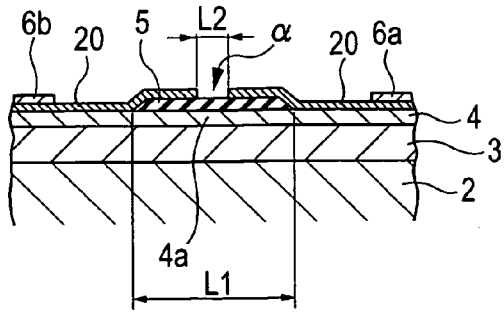
FIGS. 9A and 9B are a sectional view and a plan view, respectively, showing one step performed following the step shown in FIGS. 8A and 8B.
Figure 9B:
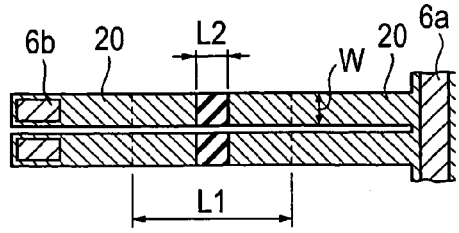

Subsequently, as shown in FIGS. 9A and 9B, opening regions α having a spacing L2 in the direction parallel to the length direction of the resistance of the heating element portion 4*a* are formed by photolithography on the heat transfer layer 20 on the insulating barrier layer 5 and, thereby, the surface of the insulating barrier layer 5 is exposed at the opening regions α. At this time, the above-described spacing L2 is made to agree the width dimension W of the insulating barrier layer 5, and the two-dimensional shape of the insulating barrier layer 5 exposed at the opening region α is made to become square. That is, the dot aspect ratio (L2/W) of the heating element portion 4*a* is made to become substantially 1. By performing this step, a pair of heat transfer layers 10 having a spacing L2 in the direction parallel to the length direction of the resistance of the heating element portion 4*a* are provided on the insulating barrier layer 5. The heat transfer layer 10 is formed from a metallic material having a melting point higher than a maximum exothermic temperature of the heating element portion 4,*a* as in the first embodiment. In particular, it is preferable that the heat transfer layer is formed from a high-melting point metallic material containing at least one of Cr, Ti, Ta, Mo, and W. Since the steps following the formation of the pair of heat transfer layers are similar to those in the above-described first embodiment, explanations thereof will not be provided.

According to this second embodiment as well, the effective heating regions of the plurality of heating element portions 4*a* are determined by the heat transfer layers 20, the effective heating regions and the dot aspect ratios (L2/W) of the plurality of heating element portions 4*a* can readily be changed by adjusting the two-dimensional sizes of the heat transfer layers 20 (spacing L2 between them, length dimension L3, and width dimension).

Figure 10:
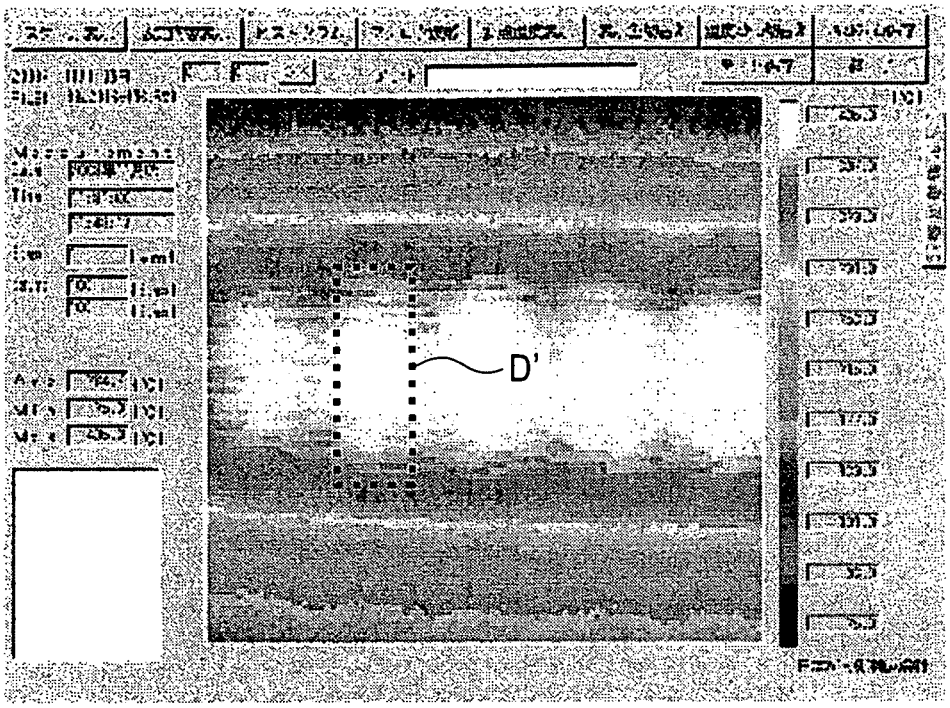
FIG. 10 is an exothermic distribution diagram showing the surface temperature condition when a plurality of heating element portions are energized in a known type thermal head shown in FIG. 12.
Figure 12A:
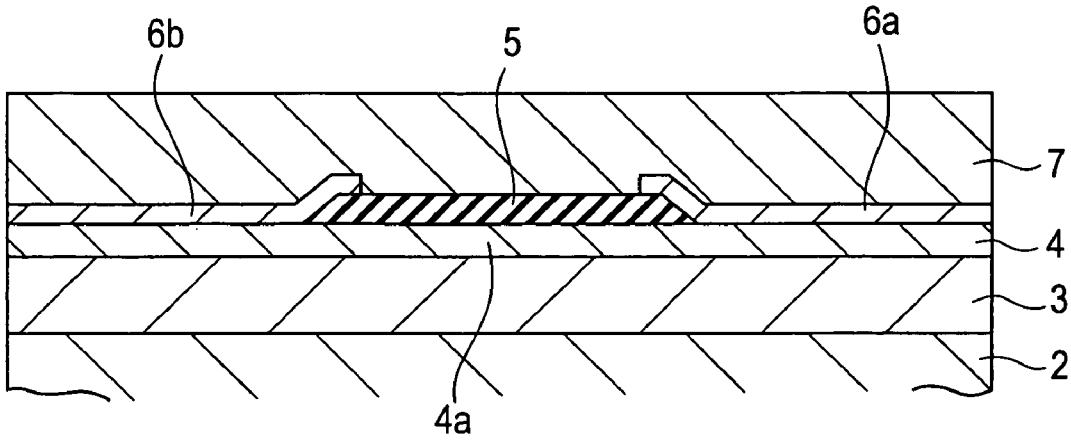
FIG. 12A PRIOR ART
FIGS. 12A and 12B are a sectional view and a plan view, respectively, showing a known type thermal head provided with no heat transfer layer.
Figure 12B:
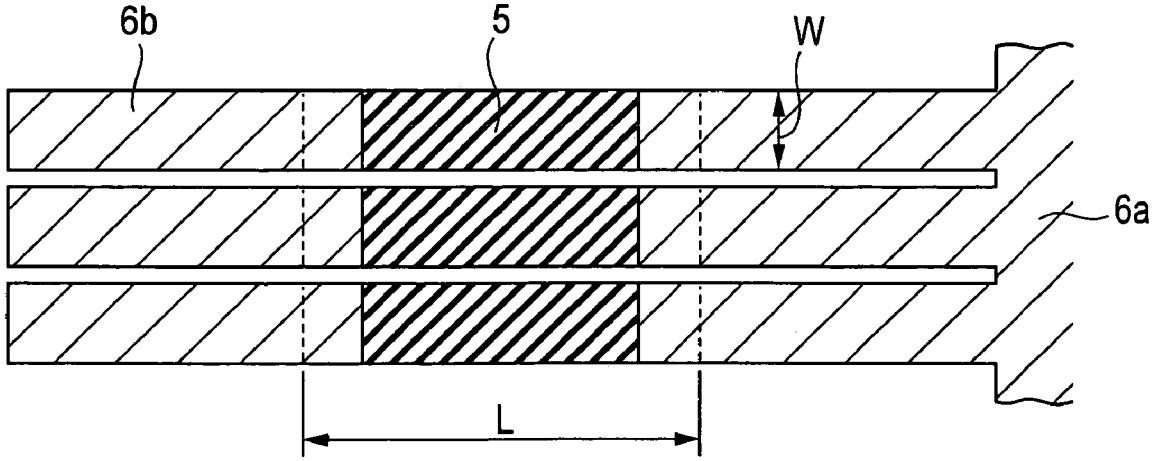
FIG. 12B PRIOR ART

FIG. 10 and FIG. 11 are exothermic distribution diagrams showing the head surface temperatures when heating element portions 4*a* are in the energized condition in a known type thermal head provided with no heat transfer layer and the thermal head 1 provided with the heat transfer layers according to the present first embodiment, respectively. In FIG. 10 and FIG. 11, dot portions of the known type thermal head and the present thermal head 1 are enclosed with broken lines. As shown in FIG. 12, the two-dimensional size (length dimension L1 and width dimension W) of each heating element portion 4*a* of the known type thermal head is determined by an insulating barrier layer 5, and a surface of the insulating barrier layer 5 is entirely exposed. Both the known type thermal head and the thermal head according to the first embodiment have resolutions on the order of 1,200 dpi. As is clear from FIG. 10, in the known type thermal head, a region in which a heating element portion 4*a* is present exhibits a highest temperature (a white region in the drawing), and a rectangular (rectangular pixel) dot portion D' is attained. On the other hand, as is clear from FIG. 11, in the thermal head 1, a region in which a heating element portion 4*a* is present and an insulating barrier layer 5 is not covered with a heat transfer layer 10 exhibits a highest temperature (a white region in the drawing), and even when the heating element portion 4*a* is present, the temperature of the region in which the insulating barrier layer 5 is covered with the heat transfer layer 10 is lower than the temperature of the above-described high-temperature region and is substantially equal to the temperature of an end portion of the electrode layer 6 on the heating element portion 4*a* side. That is, it is clear that a region in which the heating element portion 4*a* is present and the insulating barrier layer 5 is not covered with the heat transfer layer 10 contributes to the printing operation, and a square (square pixel) dot portion D is attained.

In each of the above-described embodiments, the heat transfer layer 10 (20) is formed from a high-melting point metallic material containing Cr, Ti, Ta, Mo, W, and the like, and the electrode layer 6 is formed from Al. However, the heat transfer layer 10 (20) and the electrode layer 6 may be formed from the same high-melting point metallic material. In the case where the heat transfer layer 10 (20) and the electrode layer 6 are formed from the same high-melting point metallic material, the heat transfer layer 10 (20) and the electrode layer 6 can be formed integrally and, therefore, there is an advantage that the number of manufacturing steps can be decreased.

In each of the above-described embodiments, the flat glaze type thermal head in which the heat storage layer 3 was formed all over the heat dissipating substrate 2 was described. However, the present invention can be applied to other types, e.g., partial glaze, true edge, double glaze, and DOS. Furthermore, the present invention can also be applied to a serial head and a line head.

What is claimed is:

1. A thermal head comprising a resistance layer having a plurality of heating element portions which generate heat by energization, an insulating barrier layer which is disposed covering individually the plurality of heating element portions and which determines a two-dimensional size of each heating element portion, and electrode layers electrically connected to two end portions of each of the plural heating element portions, in a length direction of resistance, the thermal head further comprising a heat transfer layer provided on at least the insulating barrier layer to determine a two-dimensional surface exposure area of the insulating barrier layer by covering part of the insulating barrier layer and to dissipate heat generated from the plurality of heating element portions, and surface exposure regions of the insulating barrier layer are specified as effective heating regions of the plurality of heating element portions by the heat transfer layer.

2. The thermal head according to claim 1, wherein a two-dimensional shape of the effective heating region of each heating element portion is specified to be square by the heat transfer layer.

3. The thermal head according to claim 1, wherein a two-dimensional shape of each heating element portion specified by the insulating barrier layer is rectangular.

4. The thermal head according to claim 1, wherein a pair of the heat transfer layers having a predetermined spacing in a direction parallel to the length direction of the resistance of the heating element portions are disposed on the insulating barrier layer, and the electrode layers are disposed on the resistance layer while being in contact with two end portions of each of the plural heating element portions in the length direction of the resistance and the heat transfer layers.

5. The thermal head according to claim 1, wherein a pair of the heat transfer layers having a predetermined spacing in a direction parallel to the length direction of the resistance of the heating element portions are disposed on the insulating barrier layer and the resistance layer, and the electrode layers are disposed on the heat transfer layers.

6. The thermal head according to claim 1, wherein the heat transfer layer is formed from a metallic material having a melting point higher than a maximum exothermic temperature of the heating element portion.

7. The thermal head according to claim 6, wherein the metallic material constituting the heat transfer layer is a high-melting point metallic material containing at least one of Cr, Ti, Ta, Mo, and W.

8. A method for manufacturing a thermal head comprising a plurality of heating element portions which generate heat by energization and electrode layers electrically connected to two end portions of each of the plural heating element portions, in a length direction of resistance, the method comprising the steps of:

forming an insulating barrier layer to determine a two-dimensional size of each heating element portion by covering surfaces of the plural heating element portions and, thereafter, forming a heat transfer layer on at least the insulating barrier layer to determine a surface exposure area of the insulating barrier layer by covering part of the insulating barrier layer and to dissipate heat generated from the plural heating element portions; and specifying surface exposure regions of the insulating barrier layer as effective heating regions of the plural heating element portions by the heat transfer layer.

9. A method for adjusting a dot aspect ratio of a thermal head comprising a plurality of heating element portions which generate heat by energization, electrode layers electrically connected to two end portions of each of the plural heating element portions, in a length direction of resistance, an insulating barrier layer to determine two-dimensional sizes of the heating element portions by covering surfaces of the plural heating element portions, and a heat transfer layer which is formed covering part of the insulating barrier layer and dissipates heat generated from the plurality of heating element portions, and adjusting an aspect ratio of an effective heating region of each heating element portion by changing the two-dimensional size of the heat transfer layer.

* * * * *